United States Patent [19]

Mayer et al.

[11] Patent Number: 5,020,242

[45] Date of Patent: Jun. 4, 1991

[54] GUIDE ROLL FOR A POROUS BELT

[75] Inventors: Wolfgang, Mayer; Wolfram Sturm; Hans-Joachim Fissmann, all of Heidenheim; Gerhard Kotitschke, Steinheim; Georg Zürn, Heidenheim; Werner Kade, Heidenheim; Georg Kugler, Heidenheim, all of Fed. Rep. of Germany

[73] Assignee: J. M. Voith GmbH, Heidenheim, Fed. Rep. of Germany

[21] Appl. No.: 490,835

[22] Filed: Mar. 8, 1990

[30] Foreign Application Priority Data

Mar. 8, 1989 [DE] Fed. Rep. of Germany ..... 3907481
May 5, 1989 [DE] Fed. Rep. of Germany ..... 3914761

[51] Int. Cl.[5] ..... F26B 13/16; F26B 13/08; D21F 3/10

[52] U.S. Cl. ..... 34/115; 34/117; 162/370

[58] Field of Search ..... 34/114, 115, 116, 117, 34/120; 162/306, 307, 368, 370

[56] References Cited

U.S. PATENT DOCUMENTS

| | | | |
|---|---|---|---|
| 2,929,450 | 3/1960 | Kurz | 162/370 |
| 2,995,186 | 8/1961 | De Montigny | 162/370 X |
| 4,024,015 | 5/1977 | Kankaanpaa | 162/307 X |
| 4,247,990 | 2/1981 | Ohls et al. | 34/115 X |
| 4,297,794 | 11/1981 | Luthi | 34/115 X |
| 4,328,626 | 5/1982 | Leitner | 34/115 |
| 4,443,300 | 4/1984 | Bubrik et al. | 162/370 X |
| 4,462,868 | 7/1984 | Oubridge et al. | 34/114 X |
| 4,485,567 | 12/1984 | Ely . | |
| 4,510,698 | 4/1985 | Ely . | |
| 4,943,351 | 7/1990 | Wedel | 34/114 X |
| 4,949,475 | 8/1990 | Roerig et al. | 34/115 |

FOREIGN PATENT DOCUMENTS

| | | | |
|---|---|---|---|
| 531879 | 1/1941 | United Kingdom | 162/370 |
| 652747 | 1/1948 | United Kingdom . | |

OTHER PUBLICATIONS

"Advances in Dryer Section Runnability", by Gregory L. Wedal and Sam Palazzolo, Sep. 1987, Tappi Journal.

*Primary Examiner*—Henry A. Bennett
*Assistant Examiner*—Christopher B. Kilner
*Attorney, Agent, or Firm*—Jeffers, Hoffman & Niewyk

[57] ABSTRACT

A guide roll for a porous belt, for instance for the drying wire of a paper machine, is described. A perforated roll shell rotates about a stationary air guide box. The guide box has two air chambers which extend across the length of the guide roll. One air chamber serves the discharge of blowing air and the other air chamber serves the intake and removal of suction air. Contained between the air guide box and the roll shell is an annular space in which a blowing zone and a suction zone are defined by longitudinal seals. Considering that blowing air and suction air may have different temperatures, the two air chambers of the air guide box are movable axially relative to each other.

26 Claims, 4 Drawing Sheets

GUIDE ROLL FOR A POROUS BELT

BACKGROUND OF THE INVENTION

The present invention concerns a guide roll for a porous belt, such as a drying wire, specifically for machines used in the manufacture or treatment of a material web, such as a paper web. Guide rolls of this type may include a hollow stationary air guide box, about which rotates a perforated roll shell having at least two air chambers that extend across the length of the guide roll. One of the air chambers serves the discharge of blowing air, and the other serves the intake and removal of suction air.

Guide rolls of this general type are known and are described, for example, in U.S. Pat. No. 4,510,698 and TAPPI Journal September, 1987, P. 65-69, FIG. 10. In view of their function, these guide rolls are also called suction/blowing rolls.

The purpose of guide rolls of this type is to supply fresh air to the pockets of a two-screen drying section of a paper machine, and at the same time to evacuate the air saturated with water vapor. This serves to avoid transverse flows in the pockets, flutter of the web edges and disuniformity in the moisture cross profile and is shown in the TAPPI article at P. 67. These problems occur with greater frequency as the operating speed of the machine, such as the paper machine, is increased.

The blowing zone is preferably located in the approach area of the guide roll and the suction zone in the departure area. However, a reverse arrangement is possible as well. To enable the blowing air supplied to the porous belt, for instance to the drying wire of a paper machine, to absorb a maximum of water vapor, it is preheated. In comparison, the temperature of the suction air is lower.

In practice, blowing air and suction air thus have very different temperatures. This temperature difference may well amount to 30°-40° and more, when the overall system is started up again cold or after a web break. The temperature differences are also large and, as the case may be, unevenly distributed when the web, specifically the paper web, is not yet passing through the drying section, for instance during the start-up of the paper machine.

Due to the temperature differences, deformations and stresses can occur in the air guide box of the guide roll. This can result in friction losses and/or destruction of the seals which separate the blowing zone and the suction zone from each other.

The problem underlying the present invention consists in providing a guide roll of the categorical type wherein deformations of the air guide box due to the temperature between the blowing air and the suction air are extensively avoided, and where there are more possibilities than before regarding the selection of size, number and arrangement of the blowing and suction zones. It is therefore desired to provide a guide roll which allows a better adaptation to different operating conditions, such as temperature differences and/or different applications.

SUMMARY OF THE INVENTION

According to the present invention, the above problem is solved in that the two air chambers of the air guide box are movable in the axial direction relative to each other.

In one embodiment of the invention, a provision may be made for arranging the two air chambers of the air guide box separately side by side, thus allowing them to expand independently from each other in longitudinal direction, and forming them from tubular sections with, for example, a semicircular cross section.

However, in accordance with a preferred embodiment of the invention, the air guide box includes two pipes of different diameter that are coaxial to each other. The pipes are so nested that they again, in accordance with the different air temperatures, can expand in longitudinal direction independently from each other. This avoids deformations of the air guide box and at the same time allows the outer pipe, which on its outside features the seals for partitioning the annular space, to have the same temperature on its entire inside. Thus, the previous risk of seal wear is extensively or even completely eliminated. In addition, the coaxial arrangement of the air chambers offers a great many possibilities for the arrangement of blowing and suction zones on the circumference of the guide roll, as will be illustrated herein.

DETAILED DESCRIPTION OF THE PREFERRED EMBODIMENT

Figure 1:
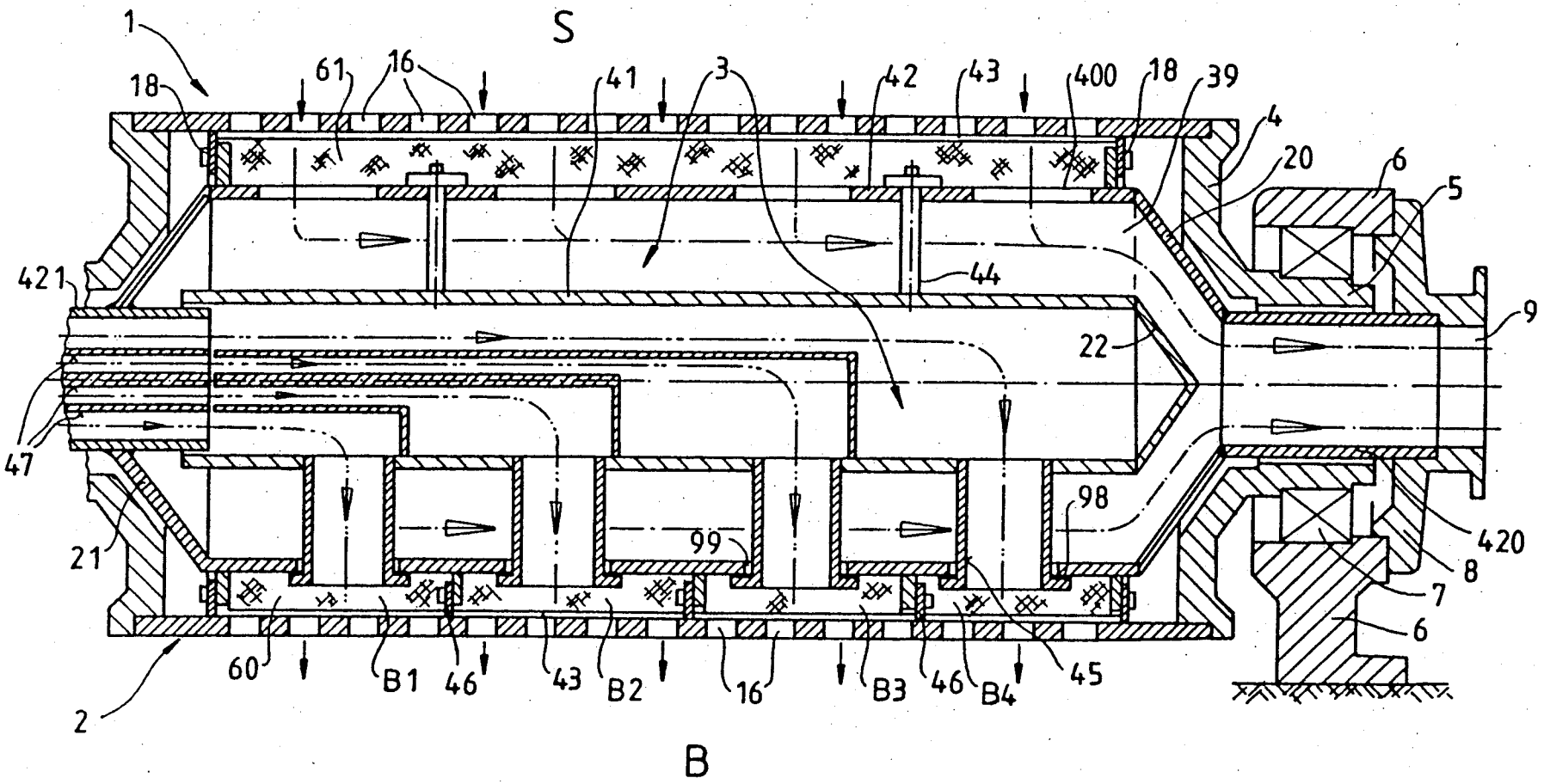
FIG. 1 shows a longitudinal section of a first embodiment of the guide roll (along line I—I in FIG. 2).
Figure 2:
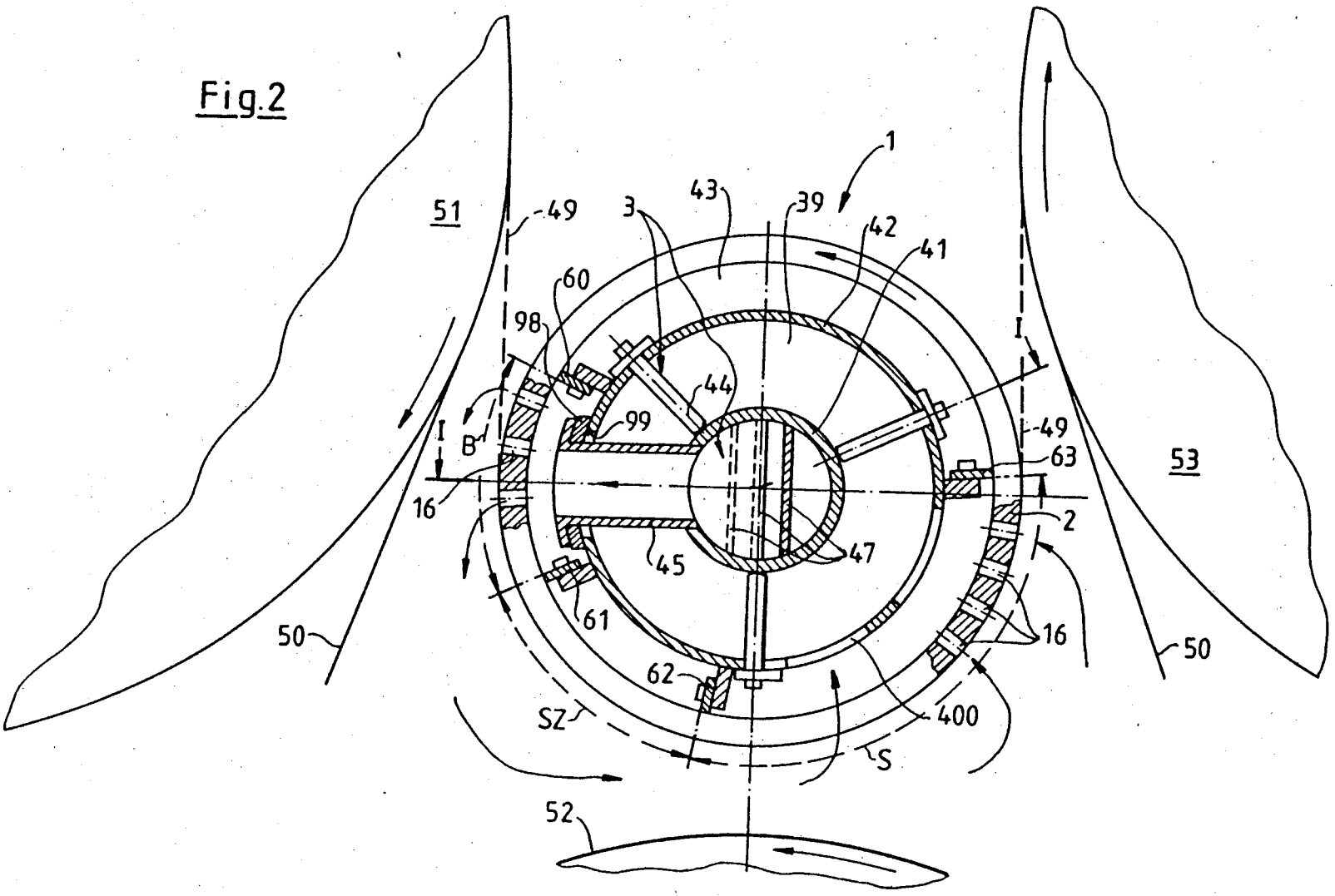
FIG. 2 shows a cross section of the guide roll according to FIG. 1 and its arrangement in a two-screen drying section of a paper machine.

The guide roll, or suction/blowing roll, illustrated in FIGS. 1 and 2 has a perforated rotating roll shell 2 and a stationary air guide box 3. The roll shell 2 is sealed on both roll ends with a flange lid 4 featuring a journal 5 which by means of an antifriction bearing 7 is mounted in a pillow block 6. A bearing cover 8 fastened on it has a conduit bore 9.

The air guide box 3 consists of two generally coaxially nested pipes with different diameters, i.e., an inside pipe 41 and an outside pipe 42. The respective diameters of the inside pipe 41, the outside pipe 42 and of the roll shell 2 are selected so that three sufficiently large air spaces are created for the air feed and venting lines. The two air chambers for the blowing air and the suction air are formed by the interior of the inside pipe 41 and by the inner annular space 39 which is contained between the inside pipe 41 and the outside pipe 42. Various zones, among them a suction zone S and a blowing zone B, are formed in the outer annular space 43 which is contained between the outside pipe 42 and the roll shell 2. For that purpose, several longitudinal seals, for instance 60 through 63, are provided which are fastened to the outside surface of the outside pipe 42 and slide on the inside surface of the rotating roll shell 2. On the ends of the outside pipe 42, peripheral seals 18 are additionally provided, which provide a lateral definition of the outer annular space 43.

The inside pipe 41 is coaxial to the roll shell 2 and has on the one roll end, through the flange lid 4 and the bearing cover 8, access to or from the outside. The outside pipe 42 is also coaxial to the roll shell 2 and also has on the other roll end coaxial access to or from the outside. The outside pipe 42 bears on the inside pipe 41 by way of a number of spacer bolts 44, which are distributed across the circumference and the length of the pipe. In addition, transverse channels in the form of pipe sections 45 are provided for connecting the interior of the inside pipe 41 with the outer annular space 43. These pipe sections 45 are fixedly connected with the inside pipe 41 and bear in axially movable fashion on the outside pipe 42. For that purpose, each pipe section 45 features a flange by way of which it bears in an appropriate bore in the outside pipe 42. A disk seal 98 is preferably inserted between the said flange and the rim of the bore 99, in the outside pipe 42. The diameter of the bore 99 is considerably larger than the outside diameter of the pipe section 45; the disk seal 98 is soft and thus flexible as a transverse shift of the pipe section 45 takes place.

With this guide roll 1 it would be possible to operate the inside pipe 41 as a suction air chamber and the outside pipe 42 as a blowing air chamber. In this case, blowing air would be fed to the inner annular space 39 and would be blown through the bores 400 in the outside pipe 42 into the annular space 43, and from there into the open through the bores 16 in the roll shell 2. Suction air would flow to the outside through the bores 16, the pipe sections 45 and the inside pipe 41. In the illustrated embodiment, things are reversed, that is, the inside pipe 41 is operated as a blowing air chamber and the outside pipe 42 as a suction air chamber.

The outside pipe 42 connects on each end, through a conical adapter 20 or 21, with a support pipe 420, 421 which extends through the journal 5 and rests in the bearing cover 8. In FIG. 1, the one support pipe 420 is open toward the inner annular space 39. Thus, suction air can flow from the outer annular space 43 through openings 400 in outside pipe 42 and through the inner annular space 39 as well as through the support pipe 420 and the bore 9, into a not illustrated suction line. The other support pipe 421 of the outside pipe 42 is open toward the inside pipe 41 and serves as a feed line for the blowing air which proceeds from the inside pipe 41 through the pipe sections 45 into the outer annular space 43. On the other end, the inside pipe 41 is sealed by, for example, a conical cover 22. The support pipe 421 and the inside pipe 41 overlap each other in such a way that the pipe 41 can be moved axially; in so doing, the inside pipe 41 slides on the spacer bolts 44 and the flanges of the pipe sections 45 along the outside pipe 42.

The blowing zone B formed in the outer annular space 43, viewed across the length of the guide roll 2, can be subdivided in a number of partial blowing zones. This is effected by means of several additional peripheral seals 46 which may be arranged between two pipe sections 45. In this way, four partial blowing zones B1, B2, B3, B4 may be obtained. The inside pipe 41 is subdivided in four partial chambers through partitioning walls 47 which then can each be connected to a blowing air supply of their own. This makes it possible to feed different amounts of blowing air to the partial blowing zones, for instance in order to influence the moisture cross profile of the paper web.

FIG. 2 shows the guide roll 1 in a so-called two-wire drying group of a paper machine. A paper web 50 to be dried departs from a first drying cylinder 51 and runs on a second drying cylinder 52; from there, the paper web 50 is passed to a third drying cylinder 53. In the process, the paper web 50 is forced on the shell of the first and the third drying cylinder 51 and 53 by means of a porous belt 49, such as a drying wire. On the way from the first to the second drying cylinder 51, 52 and from the second to the third drying cylinder 52, 53, the paper web 50 runs without any contact with the drying wire. The latter runs in the area of the "pocket" (defined by the said three drying cylinders 51, 52, 53 and the paper web 50) from the first drying cylinder 51 across the guide roll 1 to the third drying cylinder 53. The drying wire loops around the guide roll 1 on approximately one half of its circumference, forming a wrapping zone.

FIG. 2 shows additionally that in the outer annular space 43 a blowing zone B is defined, by the longitudinal seals 60 and 61, which through the pipe sections 45 connects with the inside pipe 41. The arrangement of the longitudinal seals 60 and 61 is such that the blowing zone B is located partly before and partly behind the point where the drying wire 49 runs on the guide roll. In other words, the blowing zone B is located about symmetrically to the run-on point of the drying wire 49 on the guide roll 2. In the direction of rotation, the blowing zone B is followed by a so-called barrier zone SZ which has n connection to the interior of the air guide box 3. Following next is the suction zone S, which is defined by the longitudinal seals 62 and 63 and which through the openings 400 communicate with the interior annular space 39. The suction zone S is considerably larger than the blowing zone B and ends approximately at the departure point of the drying wire 49 from the guide roll 1. Thus, the barrier zone SZ lies closer to the first cylinder 51 than to the third cylinder 53. At the same time, the arrangement is such that the distance between the barrier zone SZ and the second cylinder 52 is smaller than the distance between the barrier zone and the first cylinder 51. The effect of the barrier zone SZ is that the blowing zone B and the suction zone S do not directly border on each other. This spatial decoupling of the blowing zone from the suction zone prevents a direct air exchange (short circuit) between these two zones. Thus, the supplied blowing air proceeds sooner into the more remote areas of the pocket for an increased opportunity to absorb water vapor before it is sucked out again through the suction zone. It goes without saying that the remaining part of the annular space 43 located in the open part of the roll circumference between the longitudinal seals 63 and 60 has no connection to the interior of the air guide box 3.

FIG. 3 again depicts the paper web 50 running from a first drying cylinder 51 over a second drying cylinder 52 to a third drying cylinder 53. In variation from FIG. 2, the guide roll 1' is offset toward the first drying cylinder 51 so that the paper web 50, while proceeding from the first drying cylinder 51 to the second drying cylinder 52, at first runs together with the drying wire 49 up to the guide roll 1, and from there, without contact with the drying wire, to the second drying cylinder 52. This path of the paper web 50 from the first to the second drying cylinder, as illustrated, may be rather straight, while a variation thereof is possible as well. The drying wire 49 loops around the guide roll approximately on one half of its circumference and runs then to the third drying cylinder 53.

Figure 3:
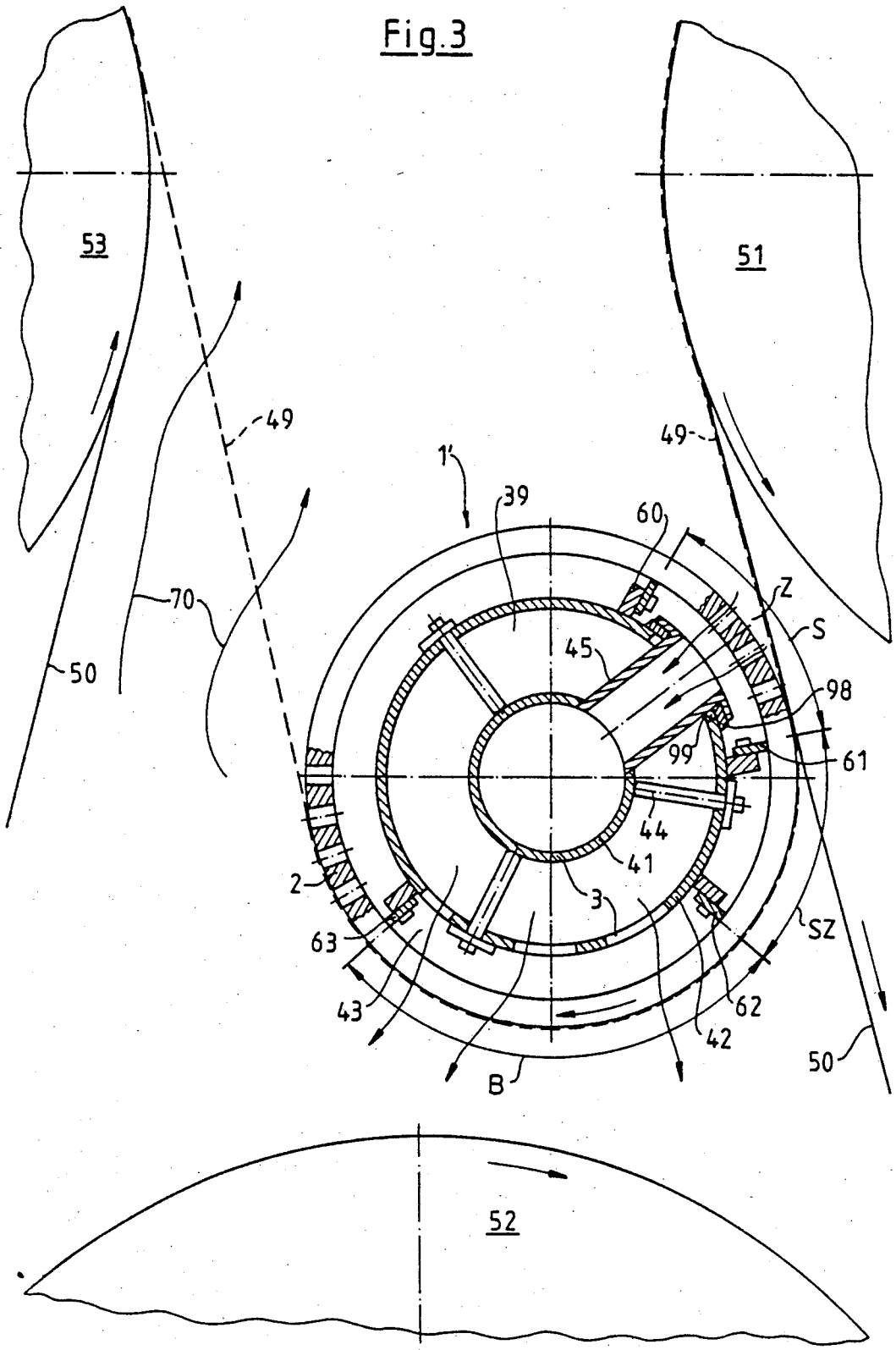
FIG. 3 shows a cross section of a second embodiment of the guide roll.

The air guide box 3 of the guide roll 1, again is composed of two approximately coaxially nested pipes with different diameters, i.e., of an inside pipe 41 and an outside pipe 42. In FIG. 3 (differing from FIG. 2) the interior of the inside pipe 41 is the air chamber for the suction air; at the same time, the inner annular space 39 between the inside pipe 41 and the outside pipe 42 is the air chamber for the blowing air. The outer annular space 43, between the outside pipe 42 and the roll shell 2, is again subdivided into different zones by means of several longitudinal seals 60 through 63.

For running the paper web 50 and the drying wire 49 as illustrated in FIG. 3, a suction zone S is arranged almost completely before the point where the drying wire 49, along with the paper web 50 (coming from the first drying cylinder 51) runs on the guide roll. A certain vacuum is generated thereby in the gore Z. The air boundary layer which is carried into this gore Z by the drying wire is thus removed by the suction/blowing roll. This keeps the air boundary layer from flowing in the area of the gore Z through the drying wire and lifting the paper web 50 off the drying wire prematurely. The suction zone S is defined by the two longitudinal seal strips marked 60 and 61.

Two additional longitudinal seal strips 62 and 63 define a blowing zone B. Contained between the suction zone S and the blowing zone B is a barrier zone SZ which communicates with neither of the two air chambers. The blowing zone B is in peripheral direction considerably larger than the suction zone S. Thus, a sufficient amount of dry blowing air can be fed into the pocket which is defined by the second cylinder 52, the paper web 50 and the drying wire 49 running across the guide roll 1. The supplied drying air is saturated in the pocket with water vapor and then upwardly vented (arrows 70), partly through the drying wire 49. It leaves the pocket partly in transverse direction.

Figure 4:
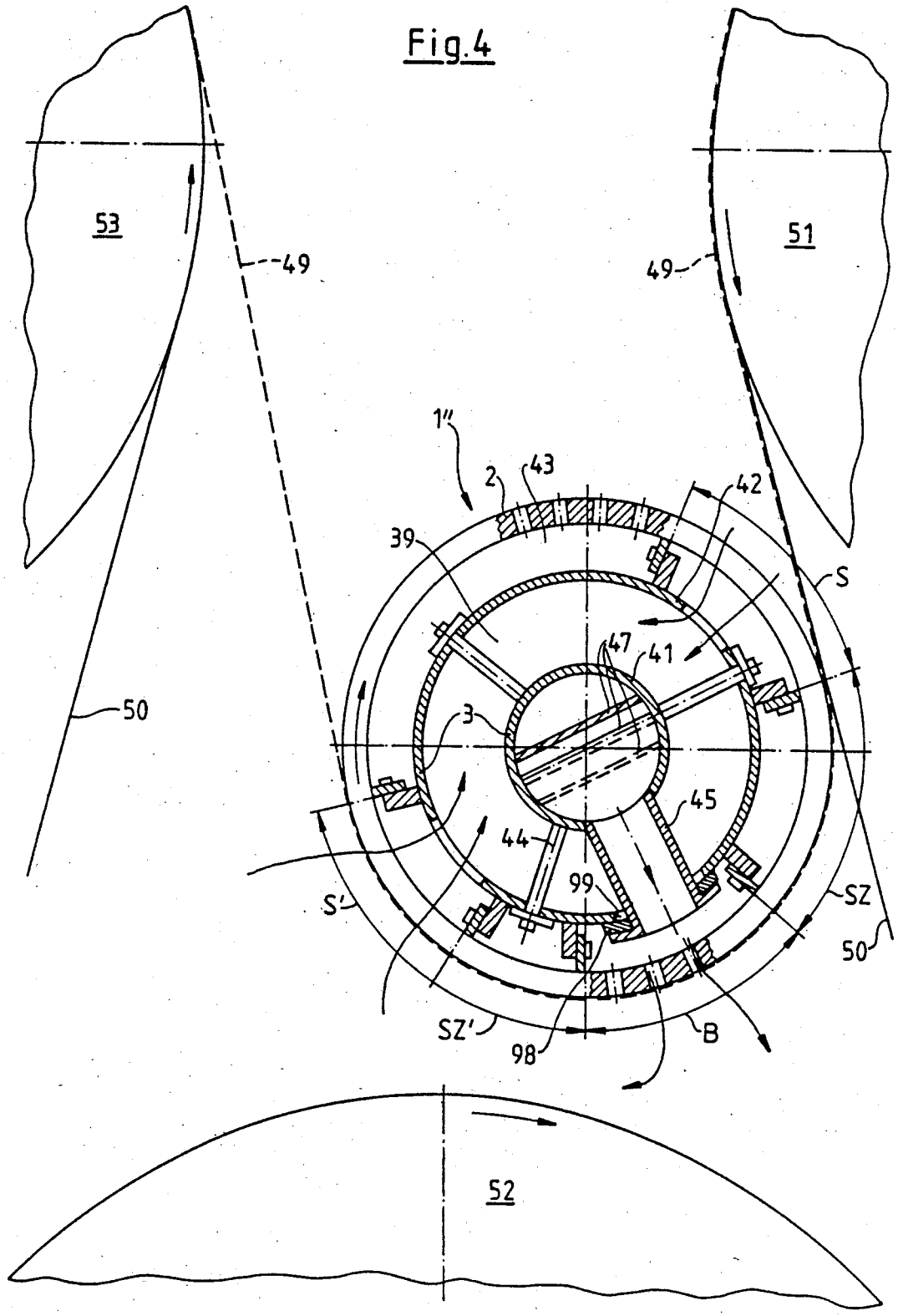
FIG. 4 shows a cross section of a third embodiment of the guide roll.

FIG. 4 shows the same arrangement of the drying cylinders 51, 52 and 53, the same arrangement of the guide roll 1'' and the same path of the paper web 50 and drying wire 49 as in FIG. 3. Different, however, is the inner structure of the guide roll 1''. Similar to FIGS. 1 and 2, the interior of the inside pipe 41 carries the blowing air while the inner annular space 39 removes the suction air. In this embodiment, the blowing zone B can be divided in partial blowing zones across its length. Accordingly, the interior of the inside pipe 41 is divided in several partial chambers through partitioning walls 47. An individually controllable amount of blowing air can be supplied to each of these partial chambers from outside. This makes it possible to influence the drying cross profile of the paper web 50.

Another difference of FIG. 4 from FIG. 3 is constituted in that in addition to the suction zone S that is present now as before, an additional suction zone S' is provided. This suction zone is located in the second quadrant of the guide roll 1' looped by the drying wire 49. The blowing zone B is somewhat smaller than in FIG. 3 and is located in the first quadrant of the guide roll 1'' looped by the drying wire 49. Barrier zones SZ and SZ' respectively, are provided on opposite sides of the blowing zone B. Part of the drying air supplied and saturated with water vapor can be removed by the additional suction zone S' through the suction/blowing roll. Thus, the embodiment according to FIG. 4 allows a better control of the removal of the moist air than the design according to FIG. 3.

A path of the paper web 50 and the drying wire 49 such as that illustrated in FIGS. 3 and 4 is known. An example may be found in U.S. Pat. No. 4,694,587. From this document it is known to generate with the aid of a blow box a vacuum in the gore where the drying wire and the paper web jointly run on the guide roll. This seeks to accomplish a safe adherence of the paper web to the drying wire and, additionally, the air movements are supposed to be controlled in the pocket mentioned above. These objectives are accomplished according to the present invention without requiring the blow box.

It will be appreciated that the foregoing is presented by way of illustration only, and not by way of any limitation, and that various alternatives and modifications may be made to the illustrated embodiments without departing from the scope of the invention.

What is claimed is:

1. A guide roll for a porous belt comprising:

a hollow stationary air guide box having at least two air chambers disposed therein, each of said air chambers extending across the length of said guide roll, said air chambers being axially movable relative to one another, one of said air chamber being in communication with a blowing zone for the discharge of blowing air, and another of said air chambers being in communication with a suction zone for the intake and removal of suction air;

means for allowing relative axial movement of said air chambers; and a perforated roll shell rotatable about said air guide box, said perforated roll shell and said air guide box defining an annular space therebetween, said annular space being divided through longitudinal seals into said blowing zone and said suction zone, said longitudinal seals being arranged on said air guide box and bearing on the inside of said roll shell.

2. A guide roll for a porous belt comprising:

a hollow stationary air guide box comprising two generally coaxially nested pipes, said pipes constituting an outside pipe and an inside pipe being axially movable relative to one another; said pipes further having an inner annular space disposed therebetween, and having an interior space disposed interiorly of said inside pipe; said inner annular space and said interior space defining two respective air chambers, each of said respective air chambers extending across the length of said guide roll; one of said air chambers being in communication with a blowing zone for the discharge of blowing air and the other of said air chambers being in communication with a suction zone for the intake and removal of suction air;

a perforated roll shell rotatable about said air guide box, said perforated roll shell and said outside pipe of said air guide box having an outer annular space disposed therebetween, said outer annular space being divided through longitudinal seals into said blowing zone and said suction zone, said longitudinal seals being arranged on said outside pipe of the air guide box and bearing on the inside of said roll shell; and transverse channel means for connecting said outer annular space to said interior space and permitting the axial movement of said outside pipe relative to said inside pipe.

3. The guide roll of claim 2, wherein said inner annular space communicates with the blowing zone and said interior of said inside pipe communicates with the suction zone.

4. The guide roll of claim 2, wherein said inner annular space communicates with the suction zone and the interior of said inside pipe communicates with the blowing zone.

5. The guide roll of claim 2, wherein said outside pipe has spacer bolts arranged thereon, said spacer bolts extending toward and bearing on said inside pipe whereby axial movement may be effected between said outside pipe and said inside pipe.

6. The guide roll of claim 3, wherein said outside pipe has spacer bolts arranged thereon, said spacer bolts extending toward and bearing on said inside pipe whereby axial movement may be effected between said outside pipe and said inside pipe.

7. The guide roll of claim 4, wherein said outside pipe has spacer bolts arranged thereon, said spacer bolts extending toward and bearing on said inside pipe whereby axial movement may be effected between said outside pipe and said inside pipe.

8. The guide roll of claim 1, wherein said blowing zone includes a plurality of axially spaced peripheral seals for dividing said blowing zone into a sequence of partial blowing zones; and wherein the air chamber which communicates with said blowing zone is subdivided by partitioning walls into partial chambers, each of said partial chambers being connected to one of said partial blowing zones and being connectable to a separately controllable blowing air feed line.

9. The guide roll of claim 2, wherein said blowing zone includes a plurality of axially spaced peripheral seals for dividing said blowing zone into a sequence of partial blowing zones; and wherein the air chamber which communicates with said blowing zone is subdivided by partitioning walls into partial chambers, each of said partial chambers being connected to one of said partial blowing zones and being connectable to a separately controllable blowing air feed line.

10. The guide roll of claim 5, wherein said blowing zone includes a plurality of axially spaced peripheral seals for dividing said blowing zone into a sequence of partial blowing zones; and wherein the air chamber which communicates with said blowing zone is subdivided by partitioning walls into partial chambers, each of said partial chambers being connected to one of said partial blowing zones and being connectable to a separately controllable blowing air feed line.

11. The guide roll of claim 2, wherein said guide roll is positioned between a first, a second, and a third drying cylinder, said respective drying cylinders being adapted to guide a paper web to be dried running successively therebetween; said guide roll further being adapted to guide said porous belt in forcing said paper web onto said first and third drying cylinders, said porous belt meeting said guide roll at a point and running over said guide roll between said first and third cylinders; and wherein said blowing zone lies partly before and partly behind said point where said porous belt runs onto said guide roll.

12. The guide roll of claim 8, wherein said guide roll is positioned between a first, a second, and a third drying cylinder, said respective drying cylinders being adapted to guide a paper web to be dried running successively therebetween; said guide roll further being adapted to guide said porous belt in forcing said paper web onto said first and third drying cylinders, said porous belt meeting said guide roll at a point and running over said guide roll between said first and third cylinders; and wherein said blowing zone lies partly before and partly behind said point where said porous belt runs onto said guide roll.

13. The guide roll of claim 11, wherein said blowing zone is smaller than said suction zone in a peripheral direction.

14. The guide roll of claim 11, wherein said porous belt forms a wrapping zone on the periphery of said guide roll, and wherein, within said wrapping zone, a barrier zone is provided between said blowing zone and said suction zone, said barrier zone communicating with neither of said two air chambers.

15. The guide roll of claim 13, wherein said porous belt forms a wrapping zone on the periphery of said guide roll, and wherein, within said wrapping zone, a barrier zone is provided between said blowing zone and said suction zone, said barrier zone communicating with neither of said two air chambers.

16. The guide roll of claim 15, wherein said barrier zone is positioned a shorter distance from said second cylinder than from said first cylinder.

17. The guide roll of claim 2, wherein said guide roll is positioned between first, second, and third respective drying cylinders, said drying cylinders being adapted to guide a paper web running successively therebetween and further to guide said porous belt, said porous belt meeting said guide roll at a point and running in a loop across a portion of the circumference of said guide roll from said first cylinder to said third cylinder for holding the paper web down on said first and third cylinders; said porous belt running together with said paper web from said first drying cylinder to said guide roll; and wherein substantially all of said suction zone is disposed on said guide roll before said point where said porous belt meets said guide roll, said blowing zone being disposed on said portion of the circumference of said guide roll looped by said porous belt.

18. The guide roll of claim 8, wherein said guide roll is positioned between first, second, and third respective drying cylinders, said drying cylinders being adapted to guide a paper web running successively therebetween and further to guide said porous belt, said porous belt meeting said guide roll at a point and running in a loop across a portion of the circumference of said guide roll from said first cylinder to said third cylinder for holding the paper web down on said first and third cylinders; said porous belt running together with said paper web from said first drying cylinder to said guide roll; and wherein substantially all of said suction zone is disposed on said guide roll before said point where said porous belt meets said guide roll, said blowing zone being disposed on said portion of the circumference of said guide roll looped by said porous belt.

19. The guide roll of claim 17, wherein said suction zone is smaller than said blowing zone in a peripheral direction.

20. The guide roll of claim 18, wherein said suction zone is smaller than said blowing zone in a peripheral direction.

21. The guide roll of claim 17, wherein a barrier zone is provided on said guide roll, said barrier zone being positioned between said suction zone and said blowing zone on said portion of the circumference of the guide roll looped by said porous belt, said barrier zone communicating with neither of the two air chambers.

22. The guide roll of claim 19, wherein a barrier zone is provided on said guide roll, said barrier zone being positioned between said suction zone and said blowing zone on said portion of the circumference of the guide roll looped by said porous belt, said barrier zone communicating with neither of the two air chambers.

23. The guide roll of claim 17, wherein said guide roll is divided into four quadrants and said porous belt is looped over two of said quadrants as it runs from said first cylinder to said third cylinder, said blowing zone being positioned substantially in a first quadrant of said guide roll looped by said porous belt, and wherein an additional suction zone is provided in a second quadrant of said guide roll looped by said porous belt.

24. The guide roll of claim 23, wherein an additional barrier zone is provided between said blowing zone and said additional suction zone on said portion of the circumference of said guide roll looped by said porous belt, said additional barrier zone communicating with neither of said two air chambers.

25. A guide roll for a drying wire comprising:

a hollow stationary air guide box comprising two generally coaxially nested pipes, said pipes constituting an outside pipe and an inside pipe being axially movable relative to one another; said pipes further having an inner annular space disposed therebetween, and having an interior space disposed interiorly of said inside pipe; said inner annular space and said interior space defining two respective air chambers, each of said respective air chambers extending across the length of said guide roll; one of said air chambers being in communication with a blowing zone for the discharge of blowing air and the other of said air chambers being in communication with a suction zone for the intake and removal of suction air;

a perforated roll shell rotatable about said air guide box, said perforated roll shell and said outside pipe of said air guide box having an outer annular space disposed therebetween, said outer annular space being divided through longitudinal seals into said blowing zone and said suction zone, said longitudinal seals being arranged on said outside pipe of the air guide box and bearing on the inside of said roll shell; and transverse channel means for connecting said outer annular space to said interior space and permitting the axial movement of said outside pipe relative to said inside pipe.

26. The guide roll of claim 25, wherein said guide roll is positioned between a first, a second, and a third drying cylinder, said respective drying cylinders being adapted to guide a paper web to be dried running successively therebetween; said guide roll further being adapted to guide said drying wire in forcing said paper web onto said first and third drying cylinders, said drying wire meeting said guide roll at a point and running over said guide roll between said first and third cylinders; and wherein said blowing zone lies partly before and partly behind said point where said drying wire runs onto said guide roll.

* * * * *

UNITED STATES PATENT AND TRADEMARK OFFICE

CERTIFICATE OF CORRECTION

PATENT NO. : 5,020,242

DATED : June 4, 1991

INVENTOR(S) : Wolfgang Mayer et al

It is certified that error appears in the above-identified patent and that said Letters Patent is hereby corrected as shown below:

Column 4, line 22, delete "n" and substitute therefor --no--.

Column 4, line 54, delete "1" and substitute therefor --1'--.

Column 4, line 62, delete "1" and substitute therefor --1'--.

Column 6, Claim 1, line 15, delete "chamber" and substitute therefor --chambers--.

Signed and Sealed this

Twenty-seventh Day of October, 1992

*Attest:*

DOUGLAS B. COMER

*Attesting Officer*

*Acting Commissioner of Patents and Trademarks*